US008632656B2

(12) United States Patent
Vehmaa et al.

(10) Patent No.: US 8,632,656 B2
(45) **Date of Patent: *Jan. 21, 2014**

(54) METHOD FOR TREATING LIQUID FLOWS AT A CHEMICAL PULP MILL

(75) Inventors: Janne Vehmaa, Siltakylä (FI); Olavi Pikka, Kotka (FI); Pekka Tervola, Espoo (FI)

(73) Assignee: Andritz Oy, Helsinki (FI)

( * ) Notice: Subject to any disclaimer, the term of this patent is extended or adjusted under 35 U.S.C. 154(b) by 693 days.

This patent is subject to a terminal disclaimer.

(21) Appl. No.: 12/664,685

(22) PCT Filed: Jun. 13, 2008

(86) PCT No.: PCT/FI2008/000068

§ 371 (c)(1),
(2), (4) Date: May 28, 2010

(87) PCT Pub. No.: WO2008/152187

PCT Pub. Date: Dec. 18, 2008

(65) Prior Publication Data

US 2010/0243184 A1 Sep. 30, 2010

(30) Foreign Application Priority Data

Jun. 15, 2007 (FI) ..... 20070477

(51) Int. Cl.
*D21C 11/00* (2006.01)

(52) U.S. Cl.
CPC ..... *D21C 11/0028* (2013.01)
USPC ..... 162/29

(58) Field of Classification Search
CPC ..... D21C 11/0028
USPC ..... 162/29
See application file for complete search history.

(56) References Cited

U.S. PATENT DOCUMENTS 4,196,043 A * 4/1980 Singh ..... 162/30.11
5,126,009 A 6/1992 Berry et al.

(Continued)

FOREIGN PATENT DOCUMENTS

CN 1247248 3/2000
CN 1616761 5/2005

(Continued)

OTHER PUBLICATIONS

Smook, Handbook for Pulp and Paper Technologists, 1992, Angus Wilde Publications, 2nd edition, chapter 10.*

(Continued)

*Primary Examiner* — Anthony Calandra
(74) *Attorney, Agent, or Firm* — Nixon & Vanderhye P.C.

(57) ABSTRACT

A method for treating liquid flows at a chemical pulp mill including at least an alkaline cooking process for producing pulp, brown stock treatment with essentially closed liquid cycles, a pulp bleaching plant using ECF-bleaching, a chemical recovery plant comprising a chemical recovery boiler, and effluent purification. Chloride-containing bleaching plant effluents are led to the effluent purification, where they are treated in order to decrease the organic matter content thereof. At least 20% of the purified effluent is returned to a pulp mill process and purified effluent is used in a last washing stage included in brown stock treatment. In the brown stock treatment the liquid flow is passed counter-currently to evaporation, wherefrom it is led for treatment to a recovery boiler process, wherein a separation process for chlorides is arranged for controlling the chloride level of the liquor cycle.

19 Claims, 2 Drawing Sheets

(56) References Cited

U.S. PATENT DOCUMENTS

| | | | | |
|---|---|---|---|---|
| 5,380,402 | A | 1/1995 | Ryham et al. | |
| 5,938,892 | A | 8/1999 | Maples et al. | |
| 6,210,527 | B1 | 4/2001 | Kirschner et al. | |
| 6,336,994 | B1 | 1/2002 | Backlund et al. | |
| 6,569,284 | B1 | 5/2003 | Yin et al. | |
| 6,752,903 | B2 * | 6/2004 | Bianchini | 162/42 |
| 2002/0036069 | A1 * | 3/2002 | Kettunen et al. | 162/47 |

FOREIGN PATENT DOCUMENTS

| | | |
|---|---|---|
| CN | 1931749 | 3/2007 |
| EP | 0 557 112 | 8/1993 |
| JP | 2001-115382 | 4/2001 |
| WO | 94/20675 | 9/1994 |
| WO | 00/75420 | 12/2000 |

OTHER PUBLICATIONS

Andritz, Catwaba Fiberline, 2005, TAPPI.*

POYRY corporation, Gunns Bell Bay Pulp Mill reports: Overview of Pulp Mill Processes [downloaded from web.archive.org], May 27, 2007 [downloaded on Jan. 28, 2013], Poyry.*

International Search Report mailed Jan. 12, 2009.

Minna Viirimaa et al., "Identification of the Wash Loss Compounds Affecting the ECF Bleaching of Softwood Kraft Pulp", Appita Journal, vol. 55, No. 6, pp. 484-488, Nov. 2002.

* cited by examiner

METHOD FOR TREATING LIQUID FLOWS AT A CHEMICAL PULP MILL

This application is the U.S. national phase of International Application No. PCT/FI2008/000068 filed 13 Jun. 2008 which designated the U.S. and claims priority to Finnish Patent Application No. 20070477 filed 15 Jun. 2007, the entire contents of which is hereby incorporated by reference.

BACKGROUND OF THE INVENTION

The present invention relates to a method for treating liquid flows at a chemical pulp mill comprising at least an alkaline cooking process for producing pulp, brown stock treatment with essentially closed liquid cycles, a pulp bleaching plant using ECF-bleaching, a chemical recovery plant comprising a chemical recovery boiler, and effluent purification.

The size of pulp mills has grown intensively during the last years, as today a pulp mill producing 1 million ton/a is of normal size and it does not seem that the growth of the size of pulp mills would be ceasing. At the same time that the size of the pulp mills is growing, the mills are being built in areas and surroundings with very strict environmental regulations. For example, the amount of water used by a mill is strongly restricted. Because the size of the mill grows, minor decreases in the water amounts used by the mill per one ton of pulp do not absolutely decrease the amount of water used by the mill, but the amount is compensated back to the same level as the production size increases. This development is difficult especially in countries where the mill simply does not have enough water available or the water resources should be saved for the needs of people and cultivation. In this kind of situation it is simply impossible to build a mill at a place where other demands of production are easily fulfilled, but due to water resources it is not possible to build a mill. Additionally, in many areas a cleaner environment is desired in such a way that the mills produce substances that are less detrimental to the environment. Therefore, it is essential to look for solutions for finding an increasingly closed process.

Chlorine-containing chemicals have been used throughout the production of chemical pulp in several different forms, of which elemental chlorine $Cl_2$, chlorine dioxide $ClO_2$ and hypochlorite NaOCl or CaOCl are the best known. Chlorine-containing chemicals have been used also inter alia in the form of hypochlorous acid in bleaching, but no permanent applications have remained in use. On the other hand, the chemical pulp industry has desired to tightly maintain a technique, in which pulp is bleached with chlorine-containing chemicals so that chlorine dioxide is the main chemical in the bleaching process of the mill. Years-long pressure to reduce the amount of organic chlorine compounds in bleaching effluents has led to the point that first the use of chlorine and hypochlorite was abandoned and further the kappa number of the pulp after digestion was decreased from level 30 to level 10-15 for soft wood and from level 16-20 to level 10-13 for hard wood using an oxygen stage. In 1990s, the aim was to abandon the use of chlorine dioxide as well and many mills switched to the use of total chlorine free (TCF) bleaching technique, wherein the use of chlorine dioxide, too, was replaced by totally chlorine-free bleaching chemicals, such as ozone and peroxide. With this technique, the mills got rid of all chlorine-containing chemicals, but on the other hand many paper producers were unsatisfied with the properties of pulp produced without chlorine chemicals. Therefore, the marginal term for all solutions relating to the closing of the mill is that chlorine dioxide is still used as bleaching chemical.

Thus the dominating position of chlorine dioxide as bleaching chemical has even gained more power during the last years, and not even the latest researches or industrial experiences have managed to destabilize its position, but as a rule the whole pulp industry, with only a few exceptions, has approved the use of chlorine dioxide as the key chemical in bleaching. Thus, if a mill is to further decrease the amount of organic chlorine compounds, the aim of the mills will be, first and foremost, to eliminate them and to treat them inside the mill, rather than to decrease the use of chlorine dioxide.

Chlorine dioxide is a chemical compound having one chlorine atom and two oxygen atoms. So, the atomic weight of the compound is about 67.5 g/l, wherefrom the portion of chlorine is 52.5%. As one chlorine dioxide as oxidation potential corresponds 2.63-fold to the oxidation potential of chlorine, it can be calculated that the use of one kilogram of chlorine dioxide in bleaching corresponds to a chlorine dose of 2.63 kg, and because 52.5% of the chlorine dioxide is in the form of chlorine atom, the bleaching stage receives only 19.9% of the amount of chlorine that would be dosed into the pulp for example in the chlorination stage. For this reason, chlorine dioxide is a compromise in view of bleaching efficiency and environmental effects, combining both a good bleaching efficiency and reasonable emissions to the surroundings.

Modern ECF-bleaching used for bleaching pulp, is typically formed of at least three bleaching stages and three washing apparatuses. In a special case there may be only two washing apparatuses, but such applications are rare. ECF-bleaching covers all such bleaching sequencies, which have at least one chlorine dioxide stage and which do not use elemental chlorine in any bleaching stage. Because the use of hypochlorite is due to pulp quality reasons restricted to the production of only a few special pulps, such as dissolving pulps, also hypochlorite is not regarded to be used in the production of ECF-pulp, but it is not totally ruled out. Additionally, the bleaching sequence comprises one alkaline stage, wherein the additional chemicals used are today typically either oxygen, peroxide or both. Further, modern bleachings may use ozone, various types of acid stages and a chelate stage for removing heavy metals. In literature, the bleaching stages are described with letters:

O=oxygen delignification
D=chlorine dioxide stage
H=hypochlorite stage
C=chlorination stage
E=alkaline extraction stage
EO=alkaline extraction stage using oxygen as additional chemical
EO=alkaline extraction stage using peroxide as additional chemical
EOP(PO)=alkaline extraction stage using oxygen and peroxide as additional chemical
P=alkaline peroxide stage
A=acid hydrolysis stage, stage of removal of hexenuronic acids
a=pulp acidation stage
Z=ozone stage
PAA=peracetic acid stage, acid peroxide stage In this patent application the chemical amount and other amounts are given per one ton of air dry pulp (adt pulp, i.e. air dry metric ton of 90% dry chemical pulp)) unless otherwise notified.

When bleaching is called ECF-bleaching, the amount of chlorine dioxide used in the bleaching sequence is more than 5 kg act. Cl/adt pulp. If chlorine dioxide is used in one bleaching stage, most typically the doses are between 5-15 kg act.

Cl/adt. The doses refer to active chlorine, whereby when converting to chlorine dioxide the dose has to be divided by a ratio of 2.63.

If the use of peroxide in bleaching is restricted to doses smaller than 6 kg and if chlorine dioxide is the main bleaching chemical, so then the chlorine dioxide dose in the bleaching increases from a level of 25 kg/adt depending on the bleaching properties of the pulp and on how much the kappa number of the pulp has been decreased before starting the bleaching using chlorine-containing chemicals. Thus, the bleaching technique may in view of the process be fairly freely adjusted to various levels of chlorine dioxide consumption so that the amount of chlorine-containing chemicals exiting the bleaching corresponds to the capacity of the chemical cycle to receive chlorides.

In connection with the present invention it is in view of practice most preferable to choose as reference sequence for hard wood a bleaching sequence A/D-EOP-D-P effected with four bleaching stages and leave ozone out. The corresponding sequence for soft wood is D-EOP-D-P. Then the quality of the pulp can be regarded to correspond to the qualities required from ECF-pulp and the pulp yield remains reasonable. Then the chlorine dioxide doses for soft wood are typically between 25-35 kg/adt and for hard wood 20-30 kg/adt. These values can be regarded as design values, and there is no need to invent any new specific techniques for bleaching. The theory of bleaching and various connection alternatives render a possibility for countless different bleaching sequences starting from the connection of two washing apparatuses up to six-stage bleaching sequences. At the same time, the number of chlorine dioxide stages may vary from one up to four and therebetween are alkaline stages as appropriate.

When the amount of active chlorine is calculated as described above in form of the chloride amount, it is noted that even with soft wood, for obtaining a good bleaching result, the bleaching line produces about 10 kg of chlorides per one ton of pulp and a hard wood bleaching line even less. If the plant is closed such that less and less of fresh water is led into bleaching, there may be a need to prepare for chlorine dioxide doses of even 50% greater, and on the other hand the amount of chlorides in bleaching effluents increases up to a level of approximately 15 kg, meaning that in practice the greatest doses of active chlorine are 60-70 kg/adt. Values higher than this cannot be considered economically reasonable, but the basic bleaching solution complies with these starting points.

One suggested technique for decreasing the environmental effects of chlorine-containing chemicals is the closing of the liquids cycles of bleaching plants, and modern bleaching plants have reached to an effluent level of 10-15 $m^3$/adt without a decrease in pulp quality. Nevertheless, even when decreasing the amount of bleaching effluent from a level of 15 $m^3$/adt to a level of 10 $m^3$/adt an increase in chemical consumption is seen, which thus leads to an ever increasing amount of organic chlorine compounds out of bleaching. Thus, a conclusion may be drawn that the closing of the water cycles of bleaching as such does not have a direct influence in the amount of organic chlorine compounds, but on the other hand a smaller amount and a greater concentration of effluents allow for easier and more economical cleaning thereof.

Chloride-containing chemicals are used in bleaching so that the total chloride dose into the chemical cycle is 5-10 kg of chlorides per one ton of chemical pulp. Because this amount has to be made to pass so that the amount of liquid to be evaporated in the process remains reasonable, the challenge is to find such a process arrangement, where a chloride-containing liquid replaces some other liquid used in a process at the mill. Thus there is no need for separate treatment stages, new non-productive by-processes at the mill, but the treatment can be carried out by means of existing process stages.

In order to be able to optimize the treatment of a chloride-containing liquid, and in practice the treatment of bleaching effluent, it is inevitable to first know the properties of the effluent. In the bleaching, inorganic chlorine-containing compounds and organic chlorine compounds from the reactions of chlorine dioxide or chlorine remain in the process. Bleaching separates from the fibers various compounds of lignin, which remain in the effluent in form of organic molecules. Additionally, sulfuric acid is used in bleaching for pH regulation and as main chemical in the hydrolysis of hexenuronic acids. Sodium hydroxide is also used for pH regulation and lignin extraction in alkaline stages. In addition to these, depending on the bleaching sequence, oxygen and peroxide are used in bleaching, which, however, are in elementary analysis such substances that their contribution in for example purification processes is not noticed. In some special cases, also hydrochloric acid may be used in pH regulation and sulfur dioxide or other reductants in elimination of chemical residuals from the bleaching, i.e. in elimination of unreacted bleaching chemicals.

Closing of the bleaching is based on recycle of filtrates of washing apparatuses from later bleaching stages to preceding stages. The bleaching is planned only for circulating filtrates between bleaching stages and pulp from one stage to another to react with different bleaching chemicals. Thus, closing the whole bleaching is as an idea based on the fact that all substances separated in bleaching end up in filtrates. Optimizing the closing of bleaching is in a great part based on the way how reaction products of bleaching disturb the process of bleaching. Although in many various connections it has been stated that different degrees of closing are possible, practical experience has shown that such washing water arrangements of bleaching where the filtrates are connected so that the amount of effluent is less than 12-13 $m^3$/adt increase the consumption of bleaching chemicals. Naturally, the quality of the pulp and the construction of the bleaching plant dictate the amount of additional chemicals used in the bleaching as the effluent amount of the plant decreases below the above presented level.

Often a research dealing with the closing of bleaching ends in a conclusion that the closing of bleaching succeeds, but the bleaching should be provided with a sink or a kidney in which harmful inorganic substances could be separated from the process. This kind of kidney is often described as a process operating with either membrane technique or ultrafiltration, which again would be a kind of new and separate by-process at the mill. In addition to that, the processes are fairly new and their continuous technical performance is not trusted. As the above-stated is combined with remarkable operational costs, the technology has not become general.

Thus, partial closing of bleaching and external purification of the generating filtrates (with a volume of 10-15 $m^3$/adt) using e.g. filtration, various known forms of biological treatment, different techniques of chemical treatment and clarification has been regarded as the so-called best available technology for bleaching effluents. After this, the treated water is led back to the water system to the same channel wherefrom the liquid was taken to the mill process or to a different channel. This is in use at both TCF- and ECF-mills. Biological treatment is efficient specifically when the proportion of detrimental organic substances is decreased, which mainly comprise lignin compounds separated in bleaching, hemicelluloses and components originating from extractives, which constitute a significant portion of effluent coming from the bleaching plant. There is an ample amount of various wood-originating compounds, and part of the compounds are chlorinated and part of them are low-molecular compounds of carbon and hydrogen. As microbes act so that they use as nutrition only the organic portion of effluent, all in-organic substances, at least in-organic elements remain in the effluent. Thus, biologically treated water has an organic load that makes it clearly cleaner than effluent treated in other ways, but due to the in-organic substances the only choice has been to discharge it from the process.

SUMMARY OF THE INVENTION

The present invention, in one embodiment, eliminates above-mentioned problems and provides a pulp production process using chlorine dioxide, in which the effluent emission is minimized such that the chloride does not accumulate in the process. Thus, when combined with an efficient chloride-removal from the process at the recovery boiler, chloride compounds led in the chemical cycle will not be a problem, but the only criterion for water being circulated at the pulp mill will be the amount of organic compounds and their adverse effect in the process. So, modern recovery boiler technique is a key to a closed pulp mill and the present invention determines the principles according to which the whole chemical cycle of a chemical pulp mill is to be arranged so that it utilizes to the maximum the possibilities provided by modern technique.

A public research was carried out at the University of Oulu, Finland, on the washing process of pulp bleaching and the operational efficiency of process stages between the washing processes compared to the efficiency of a preceding washing stage (Viirimaa, M., Dahl, O., Niinimäki, J., Ala-Kaila, K. and Perämäki, P. Identification of the wash loss compounds affecting the ECF bleaching of softwood kraft pulp. Appita Journal 55 (2002) 6, 484-488). The decrease in the bleaching stage efficiency is observed either as decreased brightness development or as a higher kappa number after a bleaching stage or bleaching stages. According to an essential result of the research, the most important individual component in the filtrate hindering the bleaching is lignin. Based on said research, two conclusions can be drawn: The amount of inorganic substances in a bleaching stage is not essential in view of the bleaching result and by specifically removing the lignin or remarkably decreasing the amount of lignin the bleaching result could be clearly improved and finally reach a bleaching result which is at the same level as in a bleaching plant, the filtrate cycles of which are not closed. This result renders a possibility of significantly optimizing the bleaching process. As the effect of inorganic compounds on chemical consumption is basically not significantly essential, for pulp washing can be accepted a washing water having significant amounts of inorganic compounds. The process according to the present invention is based on these matters.

The present invention, in one embodiment, relates to a method for treating liquid flows at a chemical pulp mill provided with an alkaline cooking process and a closed liquor-based chemical cycle. The chemical pulp mill comprises at least an alkaline cooking process for producing pulp, brown stock treatment with essentially closed liquid cycles, a pulp bleaching plant using ECF-bleaching, in which chloride-containing effluents are formed, a chemical recovery plant comprising at least black liquor evaporation, a chemical recovery boiler and chemical production, and purification of effluent. The chloride-containing effluents from the bleaching plant are led to effluent treatment, where they are treated in order to decrease the organic matter content thereof, at least 20% of the treated effluent is led back to a chemical pulp mill process, at least a portion of the returned purified effluent is used in a last washing stage included in the brown stock treatment, and in the brown stock treatment the liquid flow is passed counter-currently in relation to the pulp flow to the evaporation, wherefrom it is led for treatment to a recovery boiler process, wherein a separation process for chlorides is arranged for controlling the chloride level of the liquor cycle.

An alkaline cooking process, such as a kraft process or a sulfate process or a soda process, is based on batch cooking or continuous cooking comprising a digester or several digesters. Brown stock treatment comprises a washing process, and typically oxygen delignification, typically a screening process and washing after oxygen delignification, which washing can comprise one or several washing devices. The screening may be located after digester blowing, in the middle of or after the washing process or after oxygen delignification. These process stages are followed by a bleaching process based on ECF-technique, which comprises a pulp bleaching plant with one or more bleaching stages based on the use of chlorine dioxide in addition to stages using other known bleaching chemicals. The arrangement of the mill also comprises a chemical recovery plant comprising a black liquor evaporation process typically with an in-series connected evaporation plant, a chemical recovery boiler, removal of chlorides from the process, a chemical production plant for producing cooking chemicals.

According to a preferred embodiment of the invention the treated effluent being returned is heated by means of heat obtained from the effluent being led to purification and heated effluent is used at the chemical pulp mill. Preferably the connection comprises a heat exchanger system, in which the effluent being returned from purification is heated by means of heat obtained from the effluent being led to purification. Heated, purified effluent is used e.g. in a last washing stage included in brown stock treatment.

In accordance with an embodiment of the invention, at least 20% of the purified effluent is recycled to the pulp mill, preferably at least 40%, most preferably at least 60%. Of the recycled purified effluent at least 40%, preferably more than 60%, most preferably 80-100% is used for brown stock washing, adding it most preferably to the last washing apparatus of the washing following the oxygen stage.

Because the technique presented herein is based on solutions affecting the arrangements of the whole mill and the balance of the whole mill, it is not possible here to define in great detail all the processes which are effected by the new arrangement. Nevertheless, e.g. literature describes known processes of the whole mill, and the apparatuses and pulp production methods included in this patent application are essentially known per se. Further, the application of the present invention is based on apparatuses known per se. Thus, developing new technical innovations sometime in the future is not necessary for implementing the present invention. The present invention can be implemented at a pulp mill having a digestion process, bleaching, other treatment of pulp, chemical recovery and chemical production, which comprise various reactors, vessels, pumps, mixers, filters etc. known per se. For instance, the invention is not limited to certain washing devices, but the pulp washing apparatus using purified effluent can be a Drum Displacer™ (DD)-washer, a washing press, a drum washer, suction washer, pressure washer, disc filter or corresponding device for washing pulp.

When the effluent coming from the bleaching plant has been purified in a biological effluent treatment plant representing the newest technologies, the chemical oxygen demand, COD, thereof has decreased by more than 70% and the organic chlorine compounds content by AOX-measuring has decreased by more than 50%. If an anaerobic treatment stage is added to the system, so also the color of the water being treated has decreased remarkably. Thus, this biologically treated water is clearly cleaner than conventionally recycled filtrates in the $D_0$ stage and the first alkaline stage of the bleaching plant. The effluent can also be subjected to chemical purification methods that are based on precipitation or oxidation of oxidizable compounds. The availability of this treated filtrate at the last washing apparatus of the oxygen stage, wherefrom it is passed in remarkable amounts entrained in the pulp to the first stage of bleaching, is much better in view of the organic matter than the use of filtrates from said bleaching stages, for instance from the $D_0$-stage, in bleaching or even brown stock washing. For instance the technology definement of the European Union dealing with the technology of the forest industry, Bat, i.e. Best Available Technology, defines the object of application of the filtrate from the first alkaline stage to be the washing following the oxygen stage. On the other hand, chemical pulp producers utilizing pressing technology have already during many years diluted pulp only with a filtrate from the $D_0$ stage prior to the $D_0$-stage. Due to this connection, chemical consumption of the bleaching as a whole has increased, but nevertheless it has remained at a level that has in many cases been acceptable.

If the last apparatus before bleaching is a press or a washing press, then the water consumption thereof is divided such that the washing uses liquid in the amount of 3-6 $m^3$/adt and the pulp is discharged from the apparatus at a consistency of higher than 20%, typically at 25-35%. Because after this the situation is such that the pulp is to be diluted prior to bleaching to a pumping consistency of 8-16%, for which purpose the consumption of dilution liquid is 3-6 $m^3$/adt. Now, if both liquids are purified effluent from the purification plant, chlorides are passed into the chemical cycle. If only the dilution liquid is replaced with purified effluent from the purification plant, lignin removal provides remarkable advantages in chemical consumption compared to unpurified filtrates from the bleaching, but then the chemical cycle remains unchanged and chlorides are not passed to the recovery boiler. This can be a recommendable connection when the recovery boiler is not provided with devices by means of which chloride levels can be controlled. If, however, a press-type of washing apparatus is used, purified effluent from the purification plant can be used for washing, and fresh water, filtrate from the bleaching or a mixture of them can be used for dilution.

When treated effluent is used in brown stock washing, part of the compounds of the effluent is passed to the bleaching, especially to the first bleaching stage. As can be noted from these short definitions, the properties of treated effluent are especially preferable in bleaching, specifically in view of the organic substances. However, inorganic substances and especially various forms of chlorine molecule in organic and inorganic states have prevented the utilization of effluent in the bleaching plant and specifically in brown stock washing. However, ECF-bleaching always generates chloride compounds, because chlorine dioxide as such is a compound that contains chlorine molecules.

Due to the chemical properties of the pulp, the bleaching technology is in a situation where the bleaching effluents constitute an amount of 7-17 $m^3$/adt so that the AOX emission from the bleaching line is 0.15-0.5 kg/adt and COD 20-40 kg/adt and after purification the AOX is 0.06-0.3 kg/adt and COD 4-15 kg/adt. Thus, it can be stated that if a lower emission level is desired in an economically sustainable way, it will not happen by conventional development of processes aiming at closing. There is a need to determine a technology wherein the whole system is understood in a new way, for instance as described in the present invention.

Patent application PCT/FI2008/000053 (and corresponding U.S. patent application Ser. No. 12/107,877) describes possible techniques for treating bleaching effluents so that they are finally passed into the recovery boiler for combustion and separation. An essential feature of this application is that the treatment of chloride-containing liquids in the recovery boiler process does not lead to stronger corrosion and that the recovery boiler process is excellent for separating chloride-containing compounds from the process in order to prevent the accumulation of chlorine. There the chlorine content of flue gases is maximized by increasing the temperature of the combustion zone, where the chloride-containing liquor is combusted. Preferable combustion conditions are determined for the recovery boiler, under which chlorides will start to volatilize into flue gases, and a process location, where the chloride can be removed from the process. More than 30%, preferably more than 40% of the chlorine content of liquor being combusted is volatilized into flue gases, which are treated for removing chloride-containing compounds. Chloride and potassium are enriched in the flue gas ash, wherefrom CL and K can be removed e.g. by means of know methods, which are most typically based on leaching, evaporation-crystallization or cooling crystallization. Thus, the novel process allows making the recovery boiler a chloride sink of the mill and the whole problem caused by chloride is eliminated there, where it was previously supposed to be most harmful. If the chloride-content would grow excessively high in this solution in view of the desired temperature of steam or temperatures of steams, the final superheating or final superheatings of the steam can be carried out in a way describe in US patent applications 2005/0252458 and 2006/0236696, utilizing in the front chamber fuels that do not cause corrosion.

The above described technique allows leading the filtrates or purified effluent from the bleaching at a mill utilizing ECF-bleaching to the chemical cycle so that between the introduction point of the chloride-containing liquid and the combustion process in the recovery boiler there are no process stages for decreasing the chloride-content prior to the recovery boiler process. Thus, the novel techniques presented herein are based on a mill unity where the recovery boiler process is capable of treating the chloride contained in the normal known ECF-process without a separate separation technique prior to the recovery boiler. Known partial processes connected to the recovery boiler process, which are also utilized in this invention include e.g. methods based on dissolving, or dissolving and recrystallizing the flue ash of the recovery boiler. In sulfur-free cookings, chlorine removal can be made also from a dissolver or generally from green liquor.

A feature of an embodiment of the present invention is to provide a clearly more closed system compared to previous chemical pulp mill solutions and to present how to utilize the possibilities provided by the recovery boiler technology. The goal of all the presented solutions is:

1. Decreasing the environmental load of the chemical pulp mill
2. Keeping the use of the pulp mill's chemicals and commodities at least at the present level 3. Maintaining the quality of the pulp mill's pulp essentially at the same level than in existing processes 4. Decreasing the amount of water used by the chemical pulp mill.

Of these goals points 1 and 4 could be accomplished with the same techniques, but in that case goals 2 and 3 will be very laborious and difficult to reach with the same methods. Therefore, the technique presented herein makes all the four goals reachable simultaneously.

ECF-bleaching comprises both acid and alkaline stages. In a typical ECF-bleaching arrangement, a filtrate is discharged as effluent from the first D-stage and from the first alkaline stage. Closing of the bleaching has been studied from many starting points in several publications and the general conclusion has been a level, wherein the connection of the bleaching has been arranged so that a modern ECF-pulp mill produces bleaching effluent in the amount of 6-20 $m^3$/adt, most typically 7-16 $m^3$/adt. When the amount of generated effluent is less than 10 $m^3$/adt, it has been shown that due to the low effluent amount also the use of bleaching chemicals at the mill starts to grow. Thus, it is essential that the bleaching plant receives an adequate amount of such clean or purified water fractions, which do not increase the bleaching chemical consumption.

Now that the bleaching will be part of a closed water process, it is preferable to use oxidized white liquor as an alkaline source for alkaline stages or in neutralizing of effluent instead of clean technical sodium hydroxide. Further, the lime used in effluent neutralization can be replaced with oxidized white liquor. The reason for this is that in the present invention the alkaline liquor is recycled together with cleaned effluent to brown stock washing and therethrough into the chemical cycle.

A bleaching sequence, several of which are determined by the relevant literature in the field starting from either two-stage sequences up to historical seven-stage sequences so that after a first acid combination stage or first acid combination stages follows an alkaline stage and after that at present an acid plus acid stage or an acid plus alkaline stage. Acid stages comprise chlorine dioxide stages, ozone stages, a hexenuronic acid removal stage or some stage based on acid peroxide treatment. An alkaline stage is typically a treatment, wherein the pH is increased to exceed 7 by means of some hydroxide compound, most typically sodium hydroxide, and wherein hydrogen peroxide, oxygen, hypochlorite or some other oxidizing chemical is used as additional chemical. In this kind of arrangement, circulation water originating from a pulp drying process after the bleaching plant is introduced to the last washing apparatus located after all bleaching stages, but it can also be used in earlier stages. As this water originates from the water removal process of the drying machine, it belongs to the internal cycle of the chemical pulp mill and thus does not increase the amount of consumed water.

Brown stock treatment after the cooking process includes a washing process, and typically an oxygen stage, screening and an oxygen stage followed by washing. It is known that this process complex is arranged such that the last washing apparatus in the oxygen stage receives the purest washing liquid for facilitating the bleaching of the pulp, and the filtrate obtained from this last washing apparatus is used in accordance with countercurrent washing principles as washing liquid and in dilutions. When the filtrate is recovered from the first brown stock washing apparatus, which forms the weak black liquor, as is done also in the present invention, it is forwarded either directly to the black liquor evaporation plant or it is used in digester plant processes for dilution and displacement, after which it ends up in the black liquor flow. Although the chloride-content of this filtrate increased in the system according to the present invention, the high alkaline-content thereof converts chloride-containing compounds to salt and does not cause significant corrosion or process risk in the brown stock treatment.

In the novel solution, the whole water consumption of the mill has been modernized. Per one ton of air-dry pulp, a conventional arrangement had to use:

3-5 $m^3$ of condensate or hot water in white liquor production.

4-10 $m^3$ of condensate or hot water in brown stock washing. Hot water from the digester plant.

1-3 $m^3$ of liquid originating from bleaching chemicals, mainly from chlorine dioxide.

1-5 $m^3$ of hot water for bleaching washes for washing either the drum or rolls and e.g. to EOP-washer as washing water.

2-4 $m^3$ of fresh water to the pulp drying machine for washing of felts.

1-3 $m^3$ of cleaned or raw water to be used as sealing water and for coolings. Of this water approximately 60-80% can be circulated inside the mill.

Additionally the digester plant uses 0-6 $m^3$ of fresh water for cooling, and this water is the main source of hot water. Because the digester plant has conventionally been considered as the main source of hot water, the aim has been to produce hot water a certain amount, for instance 2-5 $m^3$.

As a result of this kind of water consumption, the flows exiting the mill can be determined: 8-11 $m^3$ together with black liquor to evaporation. Thus the condensate forms an internal cycle. The solid matter of black liquor is formed of many kinds of compounds which originate from organic, mainly lignin and carbohydrate based compounds.

Condensates are formed from various stages of the evaporation plant in the amount of 7-10 $m^3$.

8-10 $m^3$ of effluent from the bleaching to the purification plant containing the chemicals of bleaching, 1-5 $m^3$ of effluent from the drying plant from felt washing and sealing waters as well as coolings.

The sealing and cooling water flows generate 1-3 $m^3$, but these fractions can under certain preconditions be circulated with rain waters to channels. Thus, the total amount of generated effluents is 15-25 $m^3$ per a pulp ton and added thereto the effluent from wood handling. Further, also in wood handling either a filtrate from bleaching or cleaned filtrate from bleaching can be used without process problems, but as the conventional devices in wood handling are made of carbon steel, the use of a chloride-containing liquid would require revision of the material specifications.

In the novel arrangement, the water consumption per an air-dry pulp ton is mainly divided in the following way:

3-5 $m^3$ of filtrate from bleaching and/or purified effluent and/or hot water in white liquor production.

4-10 $m^3$ of purified effluent from the effluent treatment plant in brown stock washing.

1-3 $m^3$ of liquid originating from bleaching chemicals, mainly from chlorine dioxide. Now this can be replaced with e.g. condensate from the evaporation plant or filtrate from the effluent treatment plant.

1-5 $m^3$ of condensate from the evaporation plant for washes in the bleaching for washing of the drums or rolls and to the EOP-washer as washing water.

2-4 $m^3$ of condensate water to the drying machine for washing of felts.

1-3 $m^3$ of condensate from the evaporation plant or raw water to be used as sealing water and for coolings. Of this water approximately 60-80% can be circulated inside the mill. Additionally the digester plant uses 0-6 $m^3$ of fresh water for cooling, and this water is the main source of hot water. Because the digester plant has conventionally been considered as the main source of hot water, the aim has been to produce hot water a certain amount, for instance 2-5 $m^3$. However, in the novel arrangement the digester plant can heat effluent from the effluent treatment plant or the hot water is to be cooled without utilizing the heat.

As a result of this kind of water consumption, the flows exiting the mill can be determined: 9-11 $m^3$ together with black liquor to evaporation. Thus the condensate forms an internal cycle.

Condensates are formed from various stages of the evaporation plant in the amount of 6-9 $m^3$. These condensates are used at various locations in the process, as presented in the above.

10-15 $m^3$ of effluent from the bleaching to the effluent treatment plant and through the treatment plant to brown stock washing, including the chemicals from bleaching.

2-5 $m^3$ of effluent from the drying plant from felt washing and sealing waters as well as coolings.

The sealing and cooling water flows generate 1-3 $m^3$, but these fractions can under certain preconditions be circulated with rain waters to channels.

Thus, the total amount of generated effluents is 0-10 $m^3$ per a ton of pulp, more preferably 0-7 $m^3$, most preferably 0-4 $m^3$. Added thereto is the effluent from wood handling. A remarkable portion of these flows consists of sealing waters, collection waters from the channel or other sources that are secondary in view of the process.

So it can be seen that a real technological improvement is obtainable, where the goal can be set as high as to a level of 0 $m^3$/adt effluent from the process in a steady running situation.

The amount of effluent is now dependent on the efficiency of utilization of condensate in the mill processes. Additionally, the digester plant always produces a certain amount of hot water, which is either circulated to the process or, if the process does not have opportunities to utilize the water, the water is to be cooled.

Further, also in wood handling either a filtrate from bleaching or purified filtrate from bleaching can be used without process problems, but as the conventional devices in wood handling are made of carbon steel, the use of a chloride-containing liquid would require revision of the material specifications. In a normal mill process the effluents from wood handling are introduced into a common purification process, wherefrom they are returned in form of clean water to the processes of the mill.

In addition to said main streams, there are so-called secondary streams in a chemical pulp mill depending on the locations of the mill, the chosen processes and required final cleanliness levels, which streams have to be subjected to separate treatment stages when closing the mill process. This kind of streams include vent vapors containing mainly water, such a dissolver vent vapor, vent vapor from the gas scrubber of bleaching, vapor originating from flue gases, vent vapor from pulp drying or in case of an integrate even vent vapor from the paper machine drying sector, vent vapor of continuous outblow, ventings of white liquor oxidation, gassings originating from the digester plant, gaseous emissions and water vapor from the oxygen stage, water vapor concentrated from HCLV and LCHV gases and other corresponding secondary streams. Also, the combustion of hydrogen-containing substances produces water, which in the total balance of the mill converts to one liquid stream of the mill. All these have their own specific chemical features, and if the aim is a more and more closed pulp mill, e.g. microfiltration, membrane technology, ion change technique, developed evaporation techniques and other developed cleaning techniques can be needed in addition to present so-called conventional purification methods. Also these streams can be utilized, either directly or after applicable treatment stages, as process waters of the pulp mill. Thus, these secondary streams are comparable to the condensates of the evaporation plant or to purified bleaching effluent.

The streams presented herein are only examples of some possible solutions. Because there are hundreds of chemical pulp mills having processes with various connections and technologies, it is impossible to define such water usage areas that would apply for all mills. Thus, the areas and amounts presented herein are directive and set frames to the use of water at modern chemical pulp mills, and describe the possibilities that the technique presented herein will improve.

The waste liquor generated in the herein presented exemplary sulfate pulp cooking process is delivered to an evaporation plant, wherein the dry matter content thereof is increased in an in-series connected evaporation process from a level of 10-20% most commonly to a level of over 75%, which assists reaching an adequate combustion temperature, as also in the above-mentioned U.S. patent application Ser. No. 12/107,877. Waste liquor i.e. black liquor contains both alkaline compounds that are formed in the reactions of white liquor during the cooking, and cellulose, hemicellulose, lignin and extractive based substances released during the cooking.

Condensates originate from the black liquor evaporation plant, which condensates are equated with distilled water and comprise several organic small molecule substances of evaporation, which are known from literature and the best known of which is methanol, as well as inorganic compounds of sodium and sulfur. Because condensates from the evaporation plant have already during several years been used in the brown stock washing process to economize on fresh water, purification methods for purifying condensates have been developed inside the evaporator itself, such as condensate segregation systems, and external purification methods, for instance condensate stripping. Actually it is the object of application of the condensate that dictates the amount worth investing by the mill in the cleaning of condensates. Additionally, an object of study has been the oxidation of organic substances in the condensates with e.g. ozone. The condensates will be very clean and applicable in several objects in the bleaching plant and the fiber line. Now in the novel arrangement it will be inevitable to use condensate in the fiber line and other departments to new objects, because real economy and advantage in view of chemicals and pulp quality are not reached simultaneously if condensate is not utilized to full extent.

In the system presented herein condensate is used not only and mainly in brown stock washing, but the objects of application of condensate are in pulp bleaching and pulp drying machine process. Thus, the novel arrangement will require adequate cleaning of condensates, so that these can be used in new objects, which finally provide the advantage obtainable from the novel arrangement. As brown stock washing in accordance with the invention is carried out using purified effluent, the bleaching plant has to receive an adequate amount of liquid, so that via a purification process a sufficient amount of washing liquid is obtained for brown stock washing and possibly for a lime mud washing process. For that reason, a preferred water connection for bleaching is a connection, in which a sufficient amount of condensate is introduced to the washing apparatuses of bleaching, whereby 11-15 $m^3$ of effluent can be delivered to the bleaching effluent purification process.

Further, in view of the operation of the plant, it can be considered preferable, if not all effluent is returned to the process after the treatment, but 0.5-5 $m^3$/adt of effluent is led in purified form back to the water way. In view of the operation of the mill it can decrease the number of malfunction in the purification process and in mill processes connected to the use of purified effluent, although nothing prevents from using all the purified effluent at the mill.

In addition to bleaching, clean water is needed in the pulp drying plant for cleaning felts and dryer machine textiles. When the condensate is cleaned to an adequate extent, e.g. to a very low content of COD and malodorous compounds, it can be used also in dryer machine processes, such as cleaning water for felts. Further, the condensate is applicable to high-pressure washing of wires used in web formation in a drying process, but typically a precondition for this is that a significant amount of malodorous compounds has been removed from the condensate. As the objects of application of condensate this way increase remarkably, new cleaning methods in addition to conventional condensate cleaning may be needed, such as e.g. ozonization for decreasing the amount of malodorous compounds in the condensate.

The concentrate, i.e. strong black liquor formed from evaporation is combusted in a recovery boiler process, most preferably as described in the above-mentioned U.S. patent application Ser. No. 12/107,877. In that process, the liquor is combusted into energy, but also chlorine-containing inorganic and organic compounds are removed. Thus, in the arrangement according to the invention, the recovery boiler plant forms a so-called sink, wherein the chloride compounds are delivered for removal. In many discussions, a sink or a kidney has been searched for bleaching effluents prior to the recovery boiler process and typically in the fiber line, now this sink is located in the actual recovery boiler.

The chemicals to be regenerated exit the recovery boiler in form of smelt. Smelt is mainly sodium carbonate, sodium sulfide in form of cooking chemicals as well as compounds of mainly sulfur, sodium, carbon and oxygen known from literature. The smelt is dissolved below the recovery boiler in a so-called smelt dissolver, into which filtrate e.g. from lime mud washing is introduced as dissolving liquid.

Causticizing is a plant that typically comprises green liquor filtration, mixing of unslaked lime and green liquor, causticizing vessels for carrying out a causticizing reaction. In the reaction, sodium carbonate reacts with calcium oxide such that sodium hydroxide and calcium carbonate are obtained. The generated white liquor is filtered by means of filters dedicated thereto and calcium carbonate i.e. lime mud is washed by means of a lime mud filter so that it can be transferred to a lime kiln. In the lime kiln, the calcium carbonate under the effect of heat reacts to calcium oxide. Additionally, causticizing produces different precipitates from e.g. metal and organic substances, which are collected from the causticizing slaker and causticizing vessels and filters thereafter, and these are removed from the dregs filter.

As is known, a causticizing plant uses approximately 2.5-5 $m^3$/adt of fresh water, most typically 3-4 $m^3$/adt, depending on the sort of wood and the alkali requirement. This is divided so that approximately 1-2 $m^3$ is clean washing liquid for minimizing TRS-emissions and the rest 2-4 $m^3$ is condensate from the evaporation plant. These liquids that are used for washes and dilutions originate from e.g. the lime mud filter, wherein the lime mud is washed prior to the lime kiln and which thus has received part of the alkali. Because new objects of application are desired for bleaching effluents, either purified or unpurified and because in accordance with the invention an aim is to obtain chloride-containing liquids as much as possible via chemical circulation to the recovery boiler, in accordance with the invention, unpurified bleaching effluent is used for lime mud washing. As the effluent may contain compounds that are not suitable for lime mud washing, a liquid passed through a purification process can alternatively be used for the same purpose. Thus, the system can be provided with chloride-containing liquid, which can to an adequate extent be removed in the recovery boiler process.

Further, fibers and solid matter has been removed in clarification from an effluent passed through a purification plant process, so that these substances do not cause trouble in the filters in the causticizing.

However, the chemical production plant has been developed such that the water used therein is as clean as possible and above all the amount of volatile sulfur compounds is to be low. At the chemical plant liquids are needed in all the filters of the plant, such as in a green liquor filter, dregs filter or lime mud filter for dilutions and in some cases for washing. As the unpurified bleaching filtrate contains mainly non-volatile substances of lignin and cellulose, and chlorides, sodium and sulfur in form of sulfate, the emissions therefrom, e.g. TRS-effluents, do not cause a major risk. TRS-emissions are generated when substances used in lime mud washing are passed into the lime kiln and released in form of malodorous or other detrimental compounds. In the presented solution, a significant portion of the water of the white liquor plant is introduced either directly from bleaching in form of bleaching filtrate or after biological treatment, whereby the organic load has decreased significantly. Of course, in all cases it is possible to wash the lime mud with clean water even though the presented solution is used in filter dilution, in which solution a portion of the liquid is replaced with liquid fractions originating from bleaching.

As the use of liquid fraction originating from bleaching has been solved in a new way and provides clear economy either in water usage or effluent amount, it provides a possibility to contemplate installing additional devices or cleaning systems in the lime kiln. In the lime kiln, a large amount of substances regulated by environmental licenses are released, the amount of which is determined for the mill with official decision. Thus, if the mill with the novel arrangement is capable of dramatically decreasing the amount of effluent from the mill, a situation will finally be reached where the cost of the filtering and cleaning devices installed in the lime kiln is as a whole reasonable in view of the whole mill.

Because in the novel arrangement purified effluent is delivered to various objects of application in the process, different fractions of the effluent may be exposed to various types of quality requirements. Thus, the effluent treatment process can be carried out so that e.g. fractions containing more lignin are divided into one treatment line and fractions containing less lignin but more color compounds are purified in another line. Also various effluent fractions such as foul filtrate of an acid filtrate, clean fraction of an acid filtrate and alkaline filtrate can be purified in a process following the bleaching as separate fractions so that their properties in the object of reuse will be optimal.

Effluent purification processes typically comprise pretreatment, neutralization, biological treatment by an aerobic or anaerobic method and possible chemical treatment. It is possible that effluent treatment is solved using a so-called aerated lagoon, whereby the purification efficiency is lower than that of a biological effluent purification process. Finally, clarification is performed, where sludge generated from bacterial activity is removed. This sludge can be delivered further into the recovery boiler for combustion together with black liquor, which is already the practice at many mills. Chemical methods allow precipitating of detrimental substances from the effluent so that the quality of the effluent is improved. Additionally, effluent can be oxidized with e.g. ozone or oxygen. With these methods, a solution for a purification plant can be found, by means of which the effluent is made adequately clean for the presented objects of application.

The neutralization of effluent being purified changes the solubility of inorganic matter in the effluent and simultaneously boosts the precipitation of some non-process elements (NPE) during the purification process. The precipitated fractions are removed in the clarification together with sludge. Thus, the purification process improves the control of NPE.

Various methods have also been studied which are based on microfiltration and membrane technique and osmosis, which has not yet led to many industrial applications. However, their use is not excluded from the scope of the present invention.

There are several effluent treatment plant producers around the world who have their own connections for cleaning processes. Thus, the processes can not be determined universally, but they are characterized by the above-mentioned issues. Additionally, retentions etc. properties vary, so that the invention is not limited to a single known treatment plant specification.

In all purification methods it has been stated that chloride-containing inorganic substances are passed out of the mill entrained in liquid, but remarkable amount of the organic substances is either converted or decomposed as a result of purification. As an aim is to remove significant amounts of compounds that are detrimental to bleaching, it can be stated that especially biological effluent treatment reaches this goal very well. Because biological effluent treatment removes significant amounts of lignin, the water thus treated is most suitable for the purpose of being used in a brown stock washing process.

For effluent treatment, the effluent has to be cooled first so that the bacteria can act properly. Because the treated water is returned to the process most preferably at process temperature, the system is arranged by means of usual heat exchangers so that one part of an effluent cooler is reserved for the effluent to be cooled and treated effluent acts as a cooling liquid. In such a case the untreated effluent reaches the temperature that is required for effluent treatment, typically below 40° C., and the recycled liquid is heated to a temperature of 65-80° C. so that when the liquid returns to where it is used, possible heating thereof consumes reasonable amounts of steam. When an adequate number of heat exchangers is added to the system, in a most preferable situation e.g. cooling towers can be omitted, which have been used for effluent cooling in great numbers.

Another possibility for heating the treated effluent are the digester plant recirculations. The digester plant requires for the coolings a liquid at a temperature of approximately 20-60° C. and warm water or some unheated water fraction of the mill is commonly used for that purpose. If a proper material is selected for the heat exchanger, the cooling can be carried out by means of treated effluent. It is true that treated effluent contains chlorides, but because the pH is neutral or can be adjusted to be even slightly alkaline, the material does not cause an unreasonable cost.

The recycled treated effluent can, due to the presence of bacteria, be assumed to contain remarkable micro-organism activity, which may cause dirt or odor problems. Nevertheless, if the conditions of ECF-bleaching are analyzed in more detail, it can be stated that chlorine dioxide is a strong oxidant and bacterial activity is insignificant in the conditions of chlorine dioxide bleaching. Further, temperatures over 80° C. and change of pH between the bleaching stages from acid to alkaline so that also peroxide is typically present in the stage results in the situation that all remarkable organism activity is almost impossible when the treated effluent enters the bleaching stage.

As the invention presented herein has an effect on all liquid flows of the plant as a whole, when outlining the entirety the basic issues are to be understood, to which the invention provides a solution.

Now the treated effluent with a certain residual chemical oxygen consumption level and a level of organic halogens (AOX) is passed into the chemical cycle where it is in practice concentrated in evaporation to the form where it is combusted in the recovery boiler. If 90% of the effluent is returned to the chemical cycle after purification, the amount of AOX-level being passed to the water system is also reduced by approximately 90%. Thus, if the AOX amount being passed to the water system after purification would be 0.2 kg/adt, so with the novel arrangement, in which 90% of the purified effluent is recycled to the mill, a level of 0.02 kg/adt is reached. The same reduction can be noted also with chemical oxygen demand. Due to these reasons, the use of purified effluent is a real step towards a closed chemical pulp mill process and allows for an almost pollutant-free process. Nevertheless, it has to be accepted that there are some exceptional situations when effluent can not be recycled from the purification but it has to be temporarily delivered to the water system.

When a sink for the chlorides has been arranged, the process is to be arranged such that significant amounts of chloride-containing liquid flows can be fed into the sink so that the sink will remove chlorides to an adequate extent and the chlorides will not be accumulated in any cycle of the mill. In accordance with the present invention, two liquid flows are found, via which significant amounts of chlorides can be fed into the liquid flow being passed into the recovery boiler:

1. Brown stock washing and the chloride passed therefrom to the chemical cycle; and
2. White liquor production and lime mud washing.

Of these, lime mud washing may be successfully carried out partly or completely without bleaching effluent treatment, but in order to carry out the bleaching economically without major chemical additions, it is preferable that the liquid delivered to the bleaching is treated off the substances that cause quality or brightness losses in the bleaching. Thus, bleaching effluent with the dissolved lignins is purified in an external treatment with either mechanical, chemical, biological or oxidizing methods or by means of some combination of methods, where the COD of the effluent is decreased without dilution by at least 30%, preferably more than 40%, most preferably more than 60%, and/or the lignin-content of the effluent is decreased without dilution by at least 30%, preferably more than 40%, most preferably more than 60%.

A resulting effect of this is that it is worth while to use in the fiber line condensate coming from the evaporation plant in significant amounts, i.e. 1-5 $m^3$/adt, in order to maintain adequate cleanliness of the pulp and to obtain an adequate amount of liquid into the mill's liquid cycle for preventing accumulation of inorganic substances. In the novel arrangement there is a real need for this, because a conventional object of use of condensate does not exist any more. Thus, new objects of use of the mill condensates will be clean water flows of the drying machine, for instance such that the washing of felts and wires will in the future be carried out using condensates from the evaporation plant. In that case the condensates are to be cleaned so that detrimental or malodorous compounds are not released via the dryer machine or dryer room into the atmosphere.

Also, condensates can be used as sealing water. As an object at pulp mills that clearly requires clean water is sealing water in rotating apparatuses and pumps, an object for evaporation plant condensates is their use as sealing water. At present, mainly cleaned raw water of the mill is used as sealing water. In many mill the sealing water is a remarkable object of water consumption and thus causes a significant cost. As the evaporation plant condensate does not contain minerals, humus and mixed solid particles, the condensate is as such suitable to be used in mechanical apparatuses.

In rotary apparatuses the sealings are at present typically mechanical sealings, whereby the sealing is either single-acting or double-acting. In a single-acting sealing the sealing water is led into the process and the water is thus not recovered. In double-acting sealings the water comes out and can be recovered for reuse or is led into effluent treatment. Mechanical sealings are used in pumps, discharging devices, mixers, screens and scraper devices. In addition, packed sealing solutions are used in objects of application with shafts having a large diameter.

Sealing water is needed in some other devices as well, such as in washing devices. In them, also, in view of water quality it is essential that no humus or particles enter the sealing with water, but small amounts of organic compounds do not prevent the use of the condensate as sealing water. Of the known washing devices, sealing water in some form is used in e.g. the DrumDisplacer™ (DD) washer, suction drum filters, disc filters, pressure diffusers and diffusers. Additionally, sealing water is used in certain presses and washing presses. The digester plant, the evaporation plant, the drying plant, the recovery boiler and all other mill-related departments have rotary or other devices, which require sealing water, to which purpose condensate is suitable.

If the sealings are so-called double-acting sealings, the sealing water exits the device in approximately as clean a form as it was before entering the device. Therefore the sealing water can further be recovered and circulated either for sealing water without cleaning treatment or so that before reuse in a sealing the water is purified by means of some filtering method or another method.

It is to be ensured that organic substances in the condensates do not cause premature wearing, corrosion, dissolution or other kind of damaging of the sealings. This especially when the materials comprise e.g. plastic, rubber or other volcanic or polymer-based compounds.

When the sealing water is condensate, it can be used also elsewhere in the process to replace clean water, such as washing water, dilutions, cleaning water for devices and in all such objects where usually in pulp mill conditions the use of clean water is desired.

The solutions presented herein also allow using condensates or effluent in e.g. the production of chlorine dioxide water. As the chlorine dioxide water is typically made in raw water of the mill, the raw water can at some stage be replaced even with purified effluent or condensate. An essential issue is that the liquid in these flows is sufficiently cold. Cooling the condensate to a temperature below 20° C. consumes a lot of energy, but on the other hand it is possible under cold conditions. Economical issues and energy requirement in cooling are decisive in determining whether this kind of water usage is recommendable or not.

Because these arrangements as such create a particular number of process conditions to be redefined, at least the following of those can be regarded as solved:

The use of liquor so that oxidized white liquor acts in neutralization within the whole bleaching and the neutralization of effluent. This oxidized white liquor can be subjected to very strict quality requirements. Because tiosulfate is known to cause reduction of oxidizing chemicals, the following are to be set as quality requirements for oxidized white liquor: residual sulfide below 2 g/l, preferably below 1 g/l, and of the tiosulfate at least 50%, preferably more than 80% is oxidized in relation to its starting level. This goes as well for neutralization of effluent, because therethrough a remarkable portion of the effluent is returned to brown stock washing and therefrom to bleaching.

Heat exchanger arrangements, by means of which the effluent is cooled and the treated effluent is heated by cross-connected heat exchangers or the treated effluent is heated in digester circulations.

An effluent treatment process shall in the future produce such liquid which is well suitable for use mainly in two objects, brown stock washing and white liquor production. Their quality requirements may differ to such an extent that at the treatment plant they are preferably treated even as separate fractions.

When a pulp mill is arranged as presented in the above, it can be stated that in view of effluents, an almost closed pulp mill process has been invented without adding any new departments in addition to the existing ones.

The pulp mill can continue to use chlorine dioxide for guaranteeing the quality of the pulp also in a closed process.

Bleaching chemical consumption remains at essentially the same level as in the best present mill solutions and all targeted brightness levels of the pulp are reached.

SUMMARY OF THE DRAWINGS

Embodiments of the present invention ensure chemical pulping essentially without environmentally detrimental liquid effluents and with very low gaseous and solid emissions. The invention is described in more detail with reference to the accompanying figures, of which

DETAILED DESCRIPTION

Figure 1:
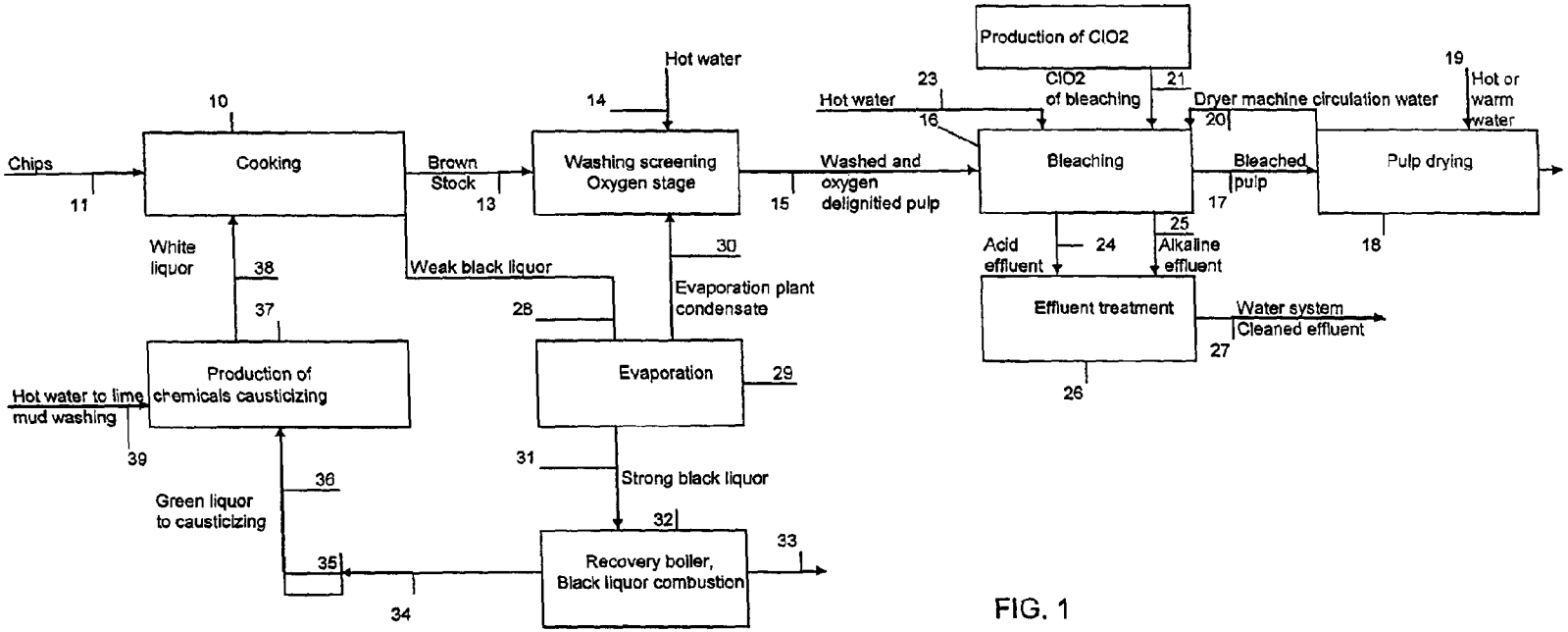
FIG. 1 is a schematic illustration of the connections of the sub-processes of a prior art pulp mill.

In the prior art system illustrated in FIG. 1, a conventional digester is illustrated with reference numeral 10, which is e.g. a continuous digester, which receives hard- or softwood chips 11 or some other comminuted cellulosic material. In the digester 10, the chips are treated with cooking chemicals under conventional temperature and pressure conditions for producing chemical pulp, e.g. kraft pulp, after which the thus generated brown stock 13 is preferably delignified with oxygen in stage 12. After the oxygen stage the pulp is washed with hot water 14, e.g. condensate. The oxygen stage typically comprises also screening.

After oxygen delignification the washed and oxygen treated pulp 15 is led to an ECF-bleaching plant 16, where it is treated in various bleaching stages, but at least one of them uses chlorine dioxide. The other bleaching stages that are used can vary, and they are also dependent on the quality of the pulp being treated. After the bleaching stages the pulp 17 can be dried in a pulp drying machine 18 and conveyed further to a paper mill. Hot or warm water 19 is introduced to the drying and the circulation water 20 of the drying machine is led to bleaching 16 to be used as clean washing water.

The bleaching sequence is e.g. A/D-EOP-D-P or D-EOP-D-P. Dioxide 21 is introduced to the bleaching as one bleaching chemical e.g. from a chlorine dioxide plant 22. Between the stages the pulp is washed, whereby the drying machine circulation water and/or fresh water 23 can be used as washing water. The washing filtrates are circulated countercurrently, but finally both acid 24 and alkaline 25 bleaching filtrates are formed, which are removed from the process to effluent treatment 26. The purified effluent 27 has typically been discharged to a water course near the mill.

According to common practice, the weak black liquor 28 is discharged from the digester 10 (or from a brown stock washer communicating with it) and it is led to evaporators 29. Condensate 30 generated in the evaporation plant is used in brown stock treatment 12 as washing liquid.

From the evaporation plant the strong black liquor 31 is finally led into a recovery boiler 32, and flue gas 33 generated therein is led into further treatment to be cleaned.

Smelt 34 obtained from the recovery boiler 19 is taken into a smelt dissolver 35 for production of green liquor. Green liquor 36 is used at a caustisizing plant for white liquor production, to which figure one refers by reference numeral 37. Insoluble precipitate material is removed from the green liquor e.g. by filtration, and the separated precipitate is further treated by means of a so-called dregs filter (not shown). The green liquor thus clarified is treated with lime for carrying out a caustisizing reaction and for production of white liquor and lime mud. The lime mud is separated from white liquor by filtration and washed. The thickened lime mud is burned in a lime kiln.

White liquor is led via a conduit 38 into the digester 10. Hot water 39 is typically introduced to the washing of lime mud separated from white liquor, whereby weak white liquor is formed, which is used in the dissolver 35.

Figure 2:
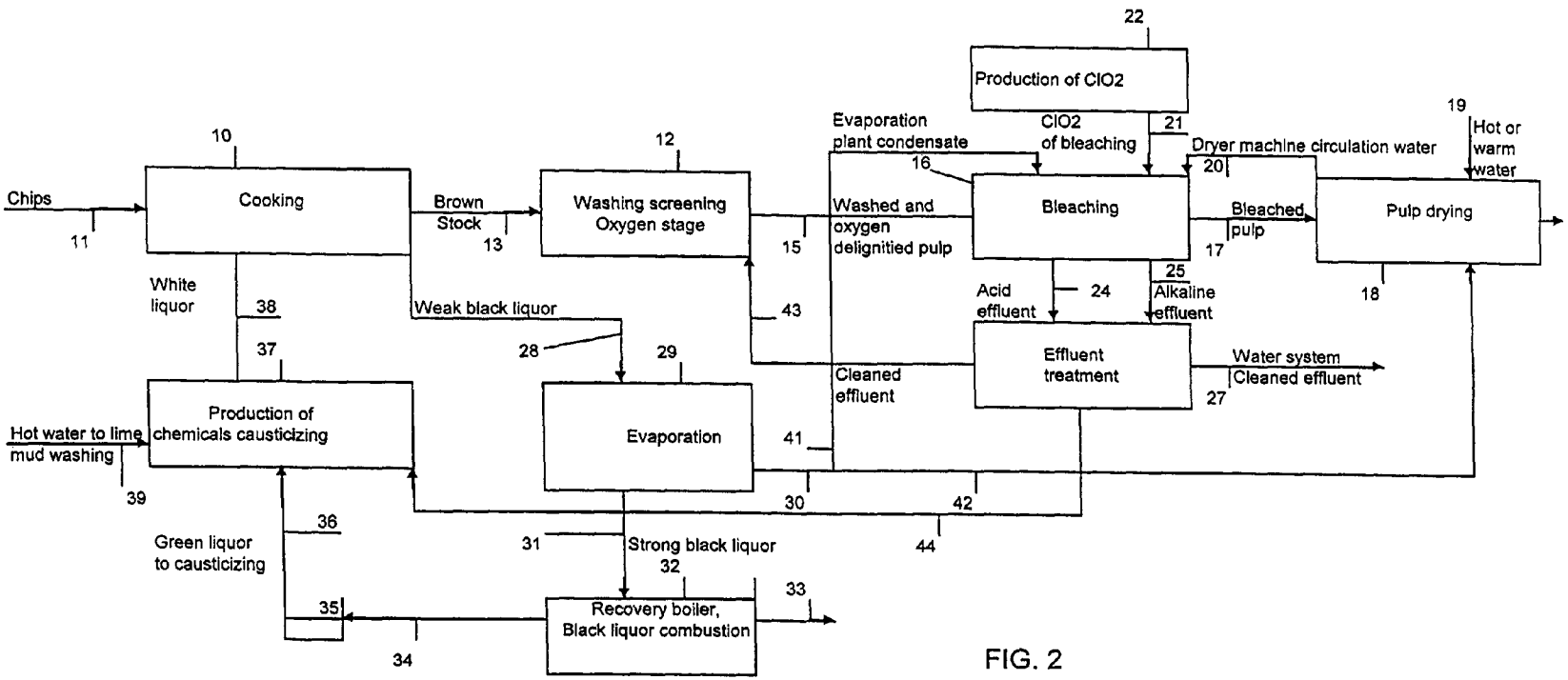
FIG. 2 is a schematic illustration of a preferred embodiment according to the present invention for carrying out the method of the invention.

FIG. 2 illustrates a preferred embodiment according to the present invention. It uses the same reference numerals as FIG. 1 where applicable.

In the process according to the invention, effluent obtained from ECF-bleaching, typically acid effluent 24 and alkaline effluent 25 are taken to an effluent treatment plant for decreasing the organic matter content thereof. When the effluent coming from the bleaching plant has been purified in a biological effluent treatment plant, the chemical oxygen demand, COD, thereof has decreased by more than 70% and the organic compounds content by AOX-measuring has decreased by more than 50%. If an anaerobic treatment stage is added to the system, so also the color of the water being treated has decreased remarkably. The effluent can also be subjected to chemical treatment methods which are based on precipitation or oxidation of oxidizable compounds. Chloride-containing effluent 43 from the purification plant 26, which effluent is cleaned off organic matter is in accordance with the invention led into washing following the oxygen stage. If the number of washing devices is two or more, the purified effluent 43 is introduced to the last of them in the pulp flow direction. From this washing device the filtrate is led by a method known per se in brown stock treatment countercurrently in relation to the pulp flow, whereby the filtrate is recovered from the first brown stock washing device in the pulp flow direction. The chloride-containing filtrate is delivered either directly to the black liquor evaporation plant 29 or it is used in digester plant processes for dilution and displacement, after which it ends up in weak black liquor flow 28 and further to the black liquor evaporation plant 29. Although the chloride-content of this filtrate increases in the system according to the invention, its high alkali content in a sulfate or soda process converts chloride-containing compounds into salt and does not cause significant corrosion or process risk in brown stock treatment. As chlorides are added in the system to different locations than before, the whole material specification of the mill is to be checked as to both apparatuses, pipings, valves and other surfaces which are in contact with the process substances. This goes for all departments of the chemical cycle, departments of the fiber line and those subdepartments where clean water is now replaced with a chloride-containing liquid in accordance with the invention.

Condensates 30 of the evaporation plant are used in the process according to the invention in FIG. 2 as washing water at the bleaching plant 16, whereto condensate is introduced via line 41. Condensate can be used instead of fresh water also in pulp drying, whereto condensate is led via line 42.

The process according to the invention also allows the use of purified chloride-containing effluent of the bleaching plant for the production of cooking chemicals. The purified effluent in line 44 is used at filters of the caustisizing plant 37, such as green liquor filters, dregs filters and/or lime mud filters, as washing liquid. The filtrates separated by means of the filters or part of the filtrates are then introduced into a smelt dissolver 35. This way, chloride-containing liquid to the system is obtained via this way too, which can be removed to a sufficient extent in the recovery boiler process.

If so required by the liquid balance of the process, purified effluent can be discharged from the process if needed via line 27.

Strong black liquor generated at the evaporation plant is combusted in a recovery boiler or if needed, the filtrate obtained from brown stock washing is evaporated separately and taken alone or together with the black liquor into the recovery boiler 32. U.S. patent application Ser. No. 12/107,877 discloses a preferred method of treating chloride-containing liquor in a recovery boiler. Thus, the treatment of chloride-containing liquids in the recovery boiler process does not lead to stronger corrosion and the recovery boiler process is excellent for separating chloride-containing compounds from the process in order to prevent the accumulation of chlorine. There the chlorine content of the flue gases 33 is maximized by increasing the temperature of the combustion zone, where the chloride-containing liquor is combusted. Preferable combustion conditions are determined for the recovery boiler, under which chlorides will start to volatilize into flue gases, and a process location, where the chloride can be removed from the process. The passing of chloride into the flue gas can be preferably enhanced by using oxygen or oxygen-enriched air. Thus, in the novel process the recovery boiler can be made the chloride sink of the mill. The chloride compounds enrich into the ash of the flue gas 33 mainly as sodium chloride and potassium chloride, wherefrom chlorine can be separated and removed from the process, as is presented e.g. in said US patent application, or in some other way. Chloride and potassium are enriched in the flue gas ash, wherefrom Cl and K can be removed e.g. by means of know methods, which are most typically based on leaching, evaporation-crystallization or cooling crystallization. Thus the recovery boiler process comprises e.g. reducing combustion, smelt dissolving, steam production for generating energy and heat and flue gas treatment as well as several sub-processes, and the chloride-removal is regarded as a sub-process included therein.

Naturally, in connection with the present invention, also other methods than those described in the above-mentioned US patent application can be used for removing chlorine in connection with the recovery boiler process and thus for controlling the chloride level of the liquor cycle.

EXAMPLES

A Test with Eucalyptus Pulp

The laboratory studies used oxygen-delignified eucalyptus pulp (kappa 11.7, viscoscity 1079 mL/g and 61.9% ISO brightness). The pulp was centrifuged to a consistency of 32%. Then the pulp was diluted with clean water or treated water (effluent from a chemical pulp mill after treatment at an activated sludge plant) to the bleaching consistency so that with the chemicals the D0-consistency was 10%. The amount of effluent was 5.7 $m^3$/adt pulp in the effluent dilution tests.

The EP-stage was carried out in an atmospheric phase at a consistency of 10% with a retention time of 75 minutes. The D1-stage was carried out in a polyethene bag at a consistency of 10% with a retention time of 75 minutes.

The test results are presented in Table 1. Based on them it can be noted that the bleachability of the pulp was the same with both liquids.

TABLE 1

| | D-EP-D | D-EP-D |
|---|---|---|
| Dilution Liquor | Clean Water | Effluent |
| D0, $ClO_2$ act. Cl, % | 2.3% | 2.3% |
| D0 kappa | 5.2 | 5.6 |
| D0 Brightness | 76 | 76 |
| EP, $H_2O_2$, % | 0.4 | 0.4 |
| EOP kappa | 4.1 | 4.4 |
| EOP Viscosity | 1035 | 1025 |
| EOP Brightness | 85.9 | 85.9 |
| D0, $ClO_2$ act. Cl, % | 0.9 | 0.9 |
| D1 Viscosity | 1005 | 990 |
| D1 Brightness | 90.1 | 89.9 |

A Test with Soft Wood Pulp (SW).

SW (Scandinavian softwood) pulp with a kappa of 16.9 after oxygen deligfication was centrifuged to a consistency of 32%. Then the pulp was diluted with clean water (demineralized water) or treated water (effluent from a chemical pulp mill after treatment at an activated sludge plant) to the bleaching consistency so that with the chemicals the D0-consistency was 10%. The amount of used treated effluent was 5.0 and 4.8 $m^3$/adt pulp in the effluent dilution tests. Two tests were made, in which the $ClO_2$, kappa factor changed.

The results are presented in Table 2. It can be seen from the results that the bleachability of the pulp was the same in the D0-stage regardless of whether clean water or treated effluent was used as dilution liquid.

TABLE 2

| Test | 1 | 2 | 3 | 4 |
|---|---|---|---|---|
| Dilution liquor | Clean Water | Effluent, treated | Clean Water | Effluent, treated |
| $ClO_2$ kappa factor, kg/bdmt (act. Cl) | 2 | 2 | 2.3 | 2.3 |
| Brightness after D0 (ISO) | 47.9 | 46.4 | 52.0 | 51.7 |
| Kappa after D0 | 8.1 | 8.3 | 7.1 | 7.2 |
| E-stage pH | 10.6 | 11.0 | 10.9 | 11.3 |
| Brightness after D0 (ISO) | 50.5 | 50.0 | 53.9 | 52.8 |
| Kappa after E | 5.3 | 5.4 | 4.3 | 4.7 |

As can be noticed from the above, the method and apparatus according to the present invention allow decreasing the emissions of a chemical pulp mill to absolute minimum. Although the above description relates to an embodiment that is in the light of present knowledge considered the most preferable, it is clear to a person skilled in the art that the invention can be modified in many different ways within the broadest possible scope defined by the appended claims alone.

The invention claimed is:

1. A method of treating liquid flows at a chemical pulp mill comprising:

alkaline cooking to produce brown stock pulp, washing the produced brown stock pulp using successive essentially closed liquid cycles, which include a last liquid cycle, wherein wash liquid flows through the liquid cycles counter-currently to the flow of the brown stock pulp through the successive essentially closed liquid cycles;

bleaching the washed brown stock pulp in a pulp bleaching plant using ECF-bleaching, in which chloride-containing effluents are formed, treating the chloride-containing effluents with a biological agent to reduce organic matter in the chloride-containing effluents, returning at least twenty percent (20%) of the treated chloride-containing effluents flow to the pulp mill, wherein at least a portion of the returned treated chloride-containing effluents are used as wash liquid in the last liquid cycle of the brown stock pulp washing step, and wash liquid effluent from the successive essentially closed liquid cycles is treated in a recovery boiler which separates chlorides from the wash liquid effluent.

2. The method according to claim 1, wherein the last washing stage washes oxygen-delignified pulp formed from the produced brown stock pulp.

3. The method according to claim 1 wherein the treatment of the chloride-containing effluents includes decreasing the lignin-content of the effluents.

4. The method according to claim 1 wherein the treatment of the chloride-containing effluents further comprises a chemical treatment.

5. The method according to claim 1, wherein the chloride-containing effluents are cooled prior to treatment with the biological agent by the treated chloride containing effluents.

6. The method according to claim 3, wherein the treated chloride-containing effluents are heated before being used as the wash liquid.

7. The method according to claim 1, further comprising diluting lime mud with the chloride-containing effluent in a lime mud washing device, and feeding weak liquor formed in the lime mud washing device into a recovery boiler dissolver.

8. The method according to claim 1, further comprising washing lime mud with the chloride-containing effluents and feeding weak liquor formed by the washing of the lime mud to a recovery boiler dissolver.

9. The method according to claim 1, further comprising using condensate from an evaporation plant as fresh water in the bleaching of the washed brown stock pulp.

10. The method according to claim 1, further comprising using condensate from an evaporation plant in a pulp drying machine.

11. The method according to claim 1, further comprising using evaporation plant condensate used as sealing water in a rotary device in the pulp mill.

12. The method according to claim 1, wherein a second stream of chloride-containing effluents from the bleaching step is treated without a biological agent and is treated separately from the chloride-containing effluents treated with the biological agent.

13. The method according to claim 1, wherein at least 40 percent of the chloride containing effluents treated with the biological agent are returned to the pulp mill.

14. The method according to claim 1 wherein at least 40 percent of the chloride containing effluents treated with the biological agent and which are returned to the pulp mill are used as the wash liquid for the brown stock washing.

15. The method according to claim 1, wherein a portion of the chloride-containing effluents are used for lime mud washing, and weak liquor formed in the lime mud washing is introduced into a recovery boiler dissolver.

16. The method according to claim 1, wherein a portion of the treated chloride-containing effluents are used at a process filter of caustisizing as dilution liquid, and weak liquor formed therein is introduced into a recovery boiler dissolver.

17. The method according to claim 1, wherein at least 80 percent of the returned treated chloride-containing effluents are used as the wash liquid for brown stock washing.

18. The method according to claim 1, further comprising using condensate originating from an evaporation plant at a drying stage for felt washing.

19. A method of treating liquid flows at a chemical pulp mill comprising:

alkaline cooking of cellulosic material to produce brown stock pulp, washing the produced brown stock pulp in a succession of closed liquid wash cycles, wherein wash liquid flows through the wash cycles in a counter-current direction to a flow direction of the produced brown stock pulp through the wash cycles;

bleaching the washed brown stock pulp in a pulp bleaching plant using ECF-bleaching and discharging chloride-containing effluent formed during bleaching;

purifying the discharged chloride-containing effluent with a biological agent to reduce organic matter in the chloride-containing effluent to produce a reduced chloride-containing effluent, and returning at least a portion of the reduced chloride-containing effluent as the wash liquid for a last wash cycle of the wash cycles.

* * * * *